US007828914B2

(12) United States Patent
Syslak et al.

(10) Patent No.: US 7,828,914 B2
(45) Date of Patent: Nov. 9, 2010

(54) METHOD FOR PRODUCING ALUMINUM ALLOY SHEET MATERIAL AND AN ALUMINIUM ALLOY SHEET

(75) Inventors: Morten Syslak, Karmsund (NO); Xiao-Jun Jiang, Haugesund (NO)

(73) Assignee: Norsk Hydro ASA, Oslo (NO)

( * ) Notice: Subject to any disclaimer, the term of this patent is extended or adjusted under 35 U.S.C. 154(b) by 635 days.

(21) Appl. No.: 10/549,673

(22) PCT Filed: Mar. 19, 2004

(86) PCT No.: PCT/NO2004/000074

§ 371 (c)(1),
(2), (4) Date: Dec. 1, 2005

(87) PCT Pub. No.: WO2004/083473

PCT Pub. Date: Sep. 30, 2004

(65) Prior Publication Data

US 2006/0118214 A1 Jun. 8, 2006

(30) Foreign Application Priority Data

Mar. 19, 2003 (NO) ..... 20031276

(51) Int. Cl.
*C22F 1/04* (2006.01)

(52) U.S. Cl. ..... 148/551; 148/552; 148/695

(58) Field of Classification Search ..... 148/415–417, 148/437–439, 549, 551, 552; 420/528–554
See application file for complete search history.

(56) References Cited

U.S. PATENT DOCUMENTS 3,827,917 A * 8/1974 Ziegler ..... 148/541
3,852,122 A 12/1974 Aarflot et al.
4,021,271 A 5/1977 Roberts
4,334,935 A 6/1982 Morris
6,238,497 B1 * 5/2001 Jin et al. ..... 148/551
6,261,706 B1 * 7/2001 Fukuda et al. ..... 428/654
6,344,096 B1 2/2002 Baumann et al.
6,531,006 B2 * 3/2003 Jin et al. ..... 148/551

FOREIGN PATENT DOCUMENTS

GB 1 457 697 12/1976

OTHER PUBLICATIONS

Heat Treating of Aluminum Alloys—Annealing, in ASM Handbook (revised vol. 4) Metals Handbook, (1998).*

* cited by examiner

*Primary Examiner*—George Wyszomierski
*Assistant Examiner*—Mark L Shevin
(74) *Attorney, Agent, or Firm*—Wenderoth, Lind & Ponack, L.L.P.

(57) ABSTRACT

The invention relates to a method and an aluminium alloy sheet material. The method of producing aluminium alloy sheet material comprising the following steps: continuous strip casting of a sheet at a predetermined solidification rate ensuring material microstructure exhibiting primary particles having average size below 1 micrometer$^2$, and (cold) rolling of the strip cast sheet to an appropriate gauge with optionally intermediate annealing during the cold rolling. It is an object of the present invention to provide a novel method of production of Al-alloy sheets applicable on heat exchanger sheet based components resulting in improved pitting corrosion applying (base) Al-alloy material with higher Fe-content.

14 Claims, 4 Drawing Sheets

METHOD FOR PRODUCING ALUMINUM ALLOY SHEET MATERIAL AND AN ALUMINIUM ALLOY SHEET

The present invention relates to a method of production of heat exchanger sheet based components and to components exhibiting improved pitting corrosion resistance provided by the method.

It is common practice to join aluminium components by disposing an aluminium brazing alloy between or adjacent to the component surfaces to be joined, and heating the brazing alloy and the joining surfaces in appropriately assembled fashion to a temperature (brazing temperature) at which the brazing alloy melts while the components remain unmelted. Upon subsequent cooling the brazing alloy forms a fillet or joint that bonds the joining surfaces of the components. For assured selective melting of only the brazing alloy in the heating step, it is commonly preferred that the melting point of the brazing alloy be at least 30 to 40° C. lower than that of the metal of the components. An example of a typical aluminium brazing alloy is an aluminium-silicon eutectic composition which starts to melt at about 577° C.

Aluminium rapidly forms a thin but tough and tenacious oxide film at room temperature, which thickens at elevated temperatures, inhibiting filler metal flow and wetting and therefore joint formation. All brazing processes are focused on the disruption or elimination of this undesirable oxide film at brazing temperatures. The most common brazing methods for aluminium heat exchangers are vacuum brazing and controlled atmosphere brazing.

The vacuum technique relies on the addition of magnesium to the braze cladding material. Magnesium evaporates into the furnace vacuum at brazing temperatures and hence disrupts the overlaying oxide film, allowing wetting and flowing of the molten filler metal.

Controlled atmosphere brazing (CAB) relies on a flux to react with and remove the aluminium oxide. Fluoride-based fluxes, e.g. a mixture of potassium tetrafluoro-aluminate and hexafluorotripotassium aluminate, are advantageous since they leave no corrosive residues.

The durability of a brazed aluminium heat exchanger in a corrosive environment is dependent on the inherent corrosion performance of each component (header, fin, tube) and their relative electrochemical behaviour. It is common practice to tailor the fin/fin-cladding and header/header-cladding in such a way that these components and the fillers become sacrificial to the tube. Furthermore, the inherent corrosion performance of each component is mainly described by the tendency and degree of pitting corrosion.

It is known that the severity of pitting corrosion in an aluminium alloy to some degree is dependent on the type of primary particle constituents and the relative electrochemical potential difference between particles and matrix. The electrochemical potential of primary particles is again dependent on the particle constituents. Iron (Fe) is a common impurity in aluminium alloys and present increase in degree of recycling of aluminium material results in relatively high iron contents. The solubility of Fe in aluminium is very low, in the order of 0.05% by weight at 655° C. (Polmear 1). Thus, most of the Fe will be present in the form of particulate precipitates. The electrochemical potential of Fe is very cathodic compared to aluminium. It is known that the electrochemical potential of Fe-based Fe-bearing particles can be made more anodic by additions of e.g. manganese, and thus the potential difference between the aluminium matrix and the particles can be reduced. It has been demonstrated that such Mn additions have had an effect on improving the pitting corrosion of an aluminium alloy.

It has been found that the inherent corrosion performance expressed by the tendency for pitting corrosion is even more dependent on the physical size of the primary particle constituents. Whereas manganese additions aiming towards leveling of the corrosion potential have increased time to perforation in SWAAT from 2-4 days to 6-8 days, controlling the particle size will give up from 20 days—indefinite life in SWAAT.

It is therefore an object of the present invention to provide a novel method of production of Al-alloy sheets applicable on heat exchanger sheet based components resulting in improved pitting corrosion applying (base) Al-alloy material with higher Fe-content.

This and other objects of the present invention are achieved by provision of a novel production method as claimed in the attached claim 1 and the resulting Al-alloy sheet in claim 7. Embodiments of the method is further defined in dependent claims 2-6, while further embodiments of the alloy sheet are defined in dependent claims 8-11.

The invention will now be described in details as illustrated by way of examples and results from SWAAT tests conducted on Al-sheet samples provided by the novel production method compared to the reference samples as illustrated in the attached FIGS. 1-5, where FIG. 1 shows a diagram of particle size distribution in the Al-sheets prior to brazing, FIG. 2 is a corresponding diagram showing particle distribution after brazing, FIG. 3 is a scanning electron microscopic image of the particles in the strip cast material according to the present invention after brazing, and FIG. 4 is the reference scanning electron microscopic image of the particles in hot rolled material after brazing.

FIG. 5 is the simulated brazing cycle utilised for the testing materials.

The present production of aluminium sheets provided with a braze cladding material comprises steps of;

casting of rolling ingot followed optionally by homogenizing, application of braze cladding material to ingot, preheating of rolling ingot to a range from 500 to 600° C., hot rolling of the clad ingot, and finally cold rolling to the specified gauge sheet.

In addition to low solidification rate, also the prolonged exposure of ingots to elevated temperatures during the hot rolling operation results in segregation of alloying elements, coarse primary particles and dispersoids. In particular this applies for the size of Fe-bearing primary particles being controlled by solidification rate.

According to the present invention an inherent characteristic of continuous strip casting process, namely cooling rate and thus solidification rate of the cast sheets being of several orders of magnitude higher compared to commercial DC cast and hot rolled ingot material, has been applied in the novel method of production.

The novel production process comprises steps of;

continuous strip casting of an Al-alloy sheet at predetermined solidification rate, in a range from $10^2$ to $10^{3}$° C./sec, and cold rolling of the cast sheet optionally followed by annealing.

In general, unclad fin material is applied to welded tube which is clad with Al—Si braze metal. After brazing, residual cladding will in some way protect the tube core from corrosion attack. By providing a flux retaining coating on the said continuous cast sheet surface, especially if the flux is (reactive) fluoride-based flux, it is possible to utilize the improved corrosion resistance of continuous strip cast sheets in manufacturing of heat exchanger components with further improved corrosion resistance. In this case, at least one of the flat surfaces of the said continuous cast sheet is coated with a reactive flux retaining coating capable of providing joints in a brazing process, characterized in that the flat surface at least partially is coated with a flux retaining composition comprising a synthetic resin based, as its main constituent, on methacrylate homopolymer or a methacrylate copolymer.

EXAMPLE

It has been demonstrated that by controlling the solidification rate during strip casting and thus producing average primary particles essentially below 1 $\mu m^2$ [1] and finer distribution of especially iron rich particles, the potential harmful cathodic effect of such particles is substantially reduced.

[1] The particle size is measured by SEM backscatter image analysis which is a two dimensional method. The particles are however found to be equiaxed meaning that a particle with an area of 1 $\mu m^2$ has a corresponding volume of 1 $\mu m^3$, i.e.: Volume=$(\sqrt{Area})^3$.

The Al-alloy AA 3003 has been strip cast according to the method of the present invention at a cooling rate in a range from $10^2$ to $10^3$° C./sec to Al-sheets at 4.5 mm thick and then cold rolled to 60 μm with optional inter-annealing during cold rolling. The 4.5 mm thick strip was cold rolled to 0.58 mm followed by an intermediate annealing. The annealing was undertaken in an air furnace by heating from room temperature to 340° C. at 30° C./hour and soaking at 340° C. for 3 hours. After cooling from 340° C. to 200° C. at 50° C./hour, the material was cooled in air. After annealing, the material was further cold rolled to 60 μm.

An identical alloy was applied to provide reference sheets produced by DC casting of the rolling ingot followed by hot rolling and cold rolling of the ingot to the identical gauge with typical commercial inter-annealing processes during cold rolling.

FIG. 1 shows the particle size and distribution of the fin materials before brazing.

FIG. 2 shows the particle size distribution of the fin material after brazing. The chemical composition of the alloys is given in Table 1. The number density of particles in the materials before and after brazing is listed in Table 2.

TABLE 1

| | Alloy | | | | | | |
|---|---|---|---|---|---|---|---|
| | Si | Fe | Cu | Mn | Mg | Zn | Ti |
| Strip cast 3003 | 0.1122 | 0.4055 | 0.0651 | 1.0560 | 0.00382 | 0.0103 | 0.0103 |
| Hot rolled 3003 | 0.1 | 0.4 | 0.07 | 1.1 | | 0.02 | |

TABLE 2

| Alloy | Condition | Particle number | Area measured ($\mu m^2$) | Number density ($\times 10^4/mm^2$) |
|---|---|---|---|---|
| Fin stock from strip cast AA 3003 | Pre-braze | 637 | 5761.15 | 11.06 |
| | Post-braze | 986 | 5761.15 | 17.11 |

TABLE 2-continued

| Alloy | Condition | Particle number | Area measured ($\mu m^2$) | Number density ($\times 10^4/mm^2$) |
|---|---|---|---|---|
| Fin stock from hot rolled AA 3003 | Pre-braze | 353 | 5761.15 | 6.13 |
| | Post-braze | 256 | 5761.15 | 4.44 |

It is well known that the pitting corrosion in 3xxx series alloys is prone to initiate from coarse Fe-bearing particles. When increasing the size of the Fe-bearing particles the cathodic area will be increased in the alloy. As a consequence, the rate of pitting corrosion will be increased in the vicinity of the Fe-bearing particles. This is detrimental to the corrosion performance of the alloy.

Figure 1:
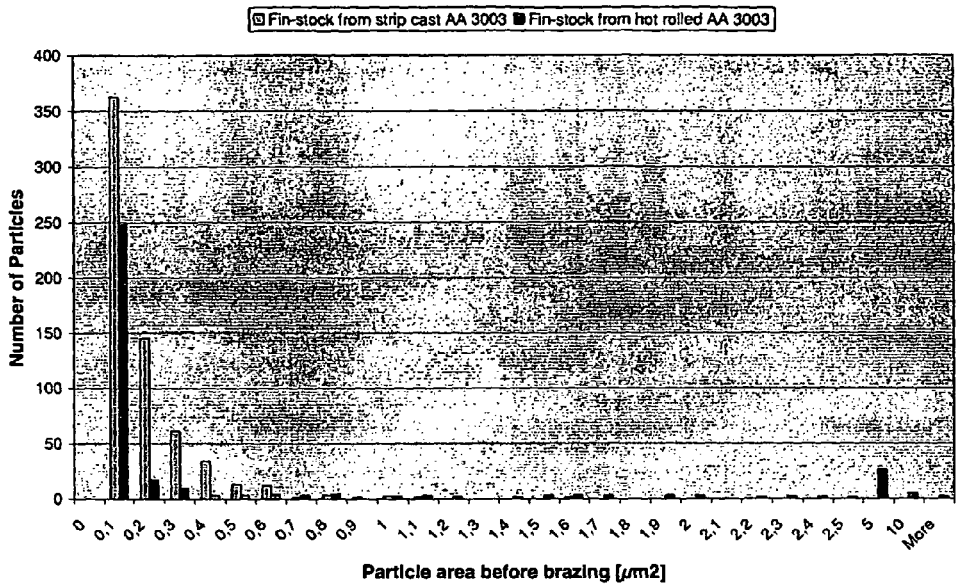
Figure 2:
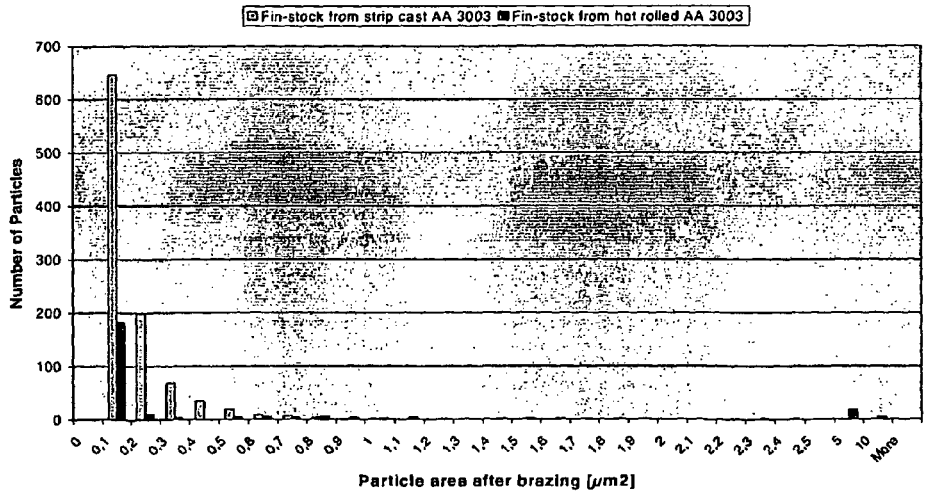
Figure 3:
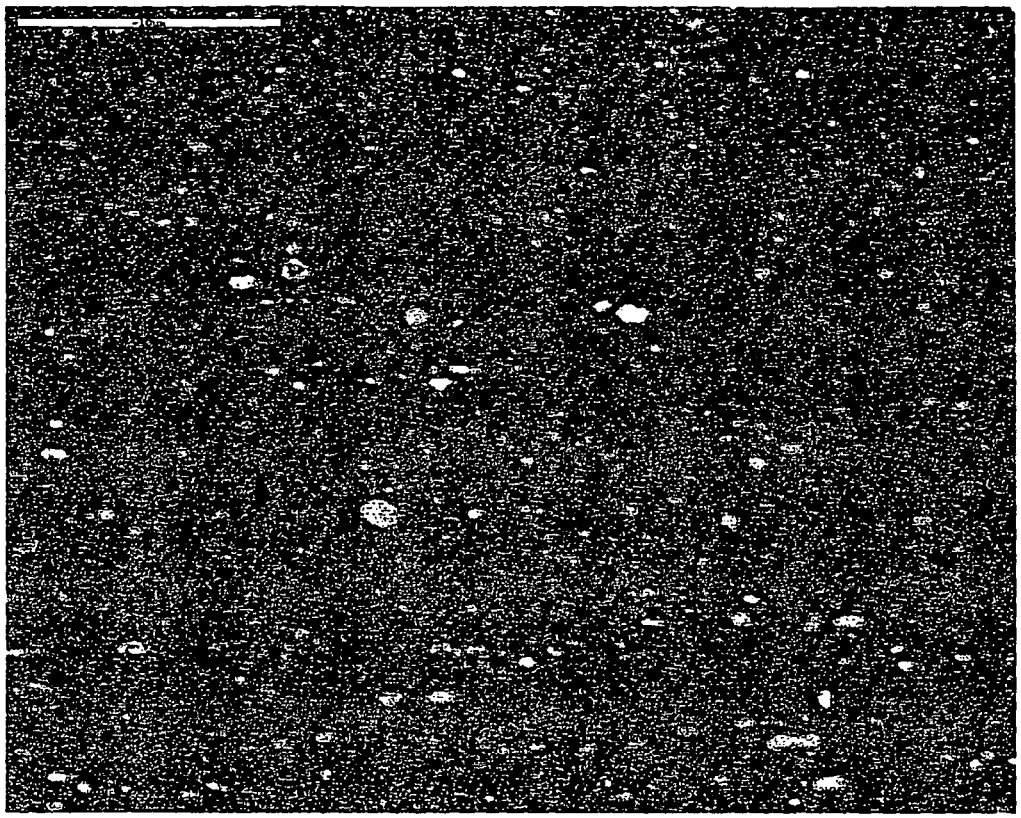
FIG. 3 is the scanning electron microscopic back scattering image of the particles in the strip cast fin material after brazing.
Figure 4:
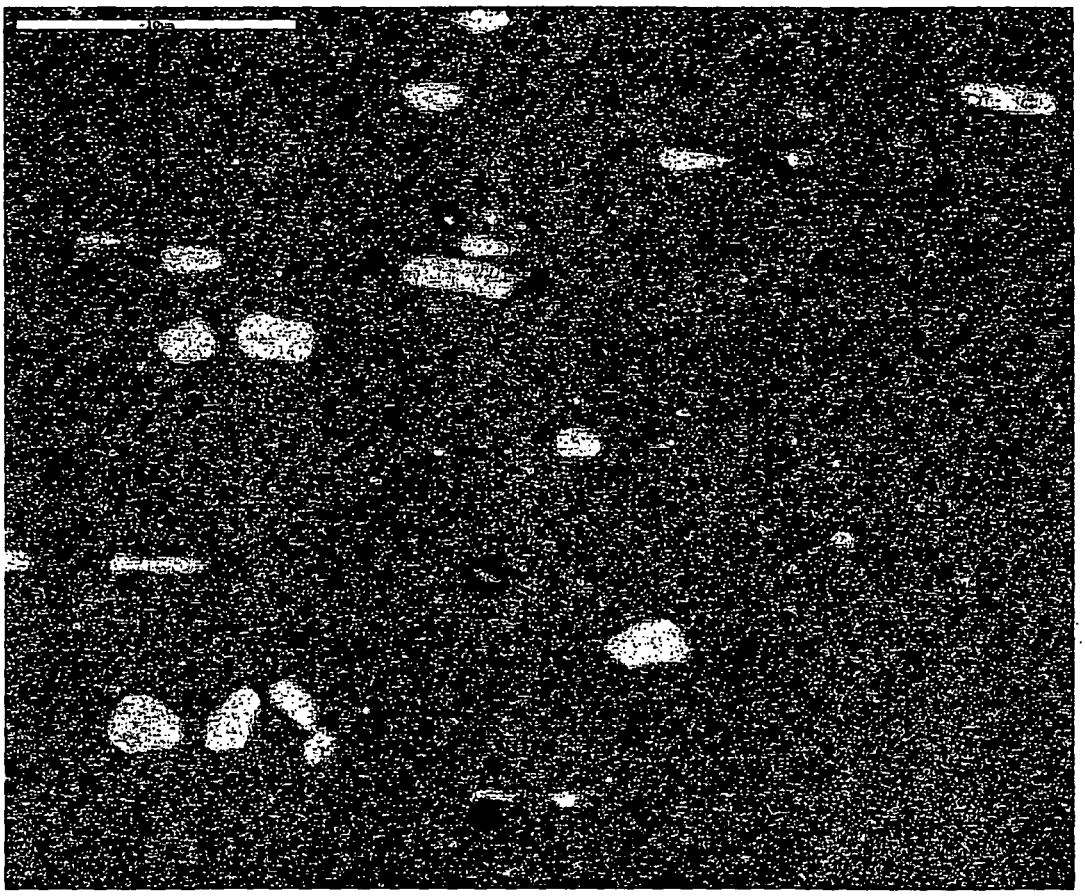
FIG. 4 is the scanning electron microscopic back scattering image of the particles in the hot rolled fin material after brazing.
Figure 5:
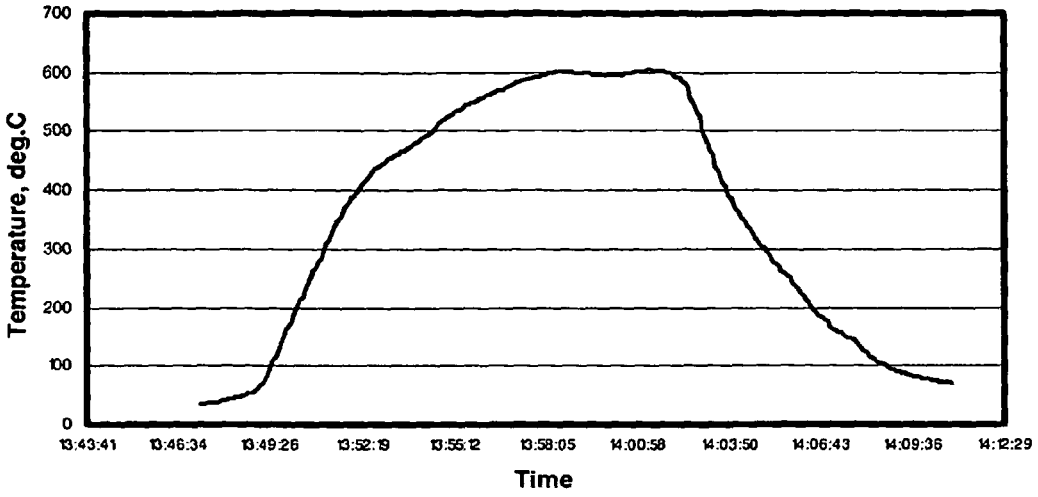
FIG. 5 is the simulated brazing cycle utilised for the testing materials.

In general, as seen in FIGS. 3 and 4, there are two types of Fe-bearing particles in AA 3003 alloys. One is $Al_6(Fe,Mn)$ exhibiting coarser particles and another one is α-AlMnFeSi (fine particles). From the results in the attachment, it can be seen that the strip cast fin material contains dense fine particles of two types before and after brazing, and very few particles are larger than 1 $\mu m^2$. However, the particles in the hot rolled fin material have bimodal character consisting of small dispersoids of α-AlMnFeSi and coarse particles of $Al_6(Fe,Mn)$ (typical size larger than 5 $\mu m^2$) before and after brazing. After brazing, the number density of the particles in the strip cast material is about four times as that in the hot rolled material (see Table 1). So, the size and distribution of the Fe-bearing particles in the fin alloy can be controlled and modified through continuous strip casting followed by proper processing. This is very beneficial for fin alloys in terms of corrosion performance.

Furthermore, as it has been mentioned previously that by provision of a flux retaining coating on such provided cast sheet surface, especially if the flux is (reactive) fluoride-based flux, it is possible to utilize the improved corrosion resistance of strip cast sheets in manufacturing of heat exchanger components. One example is that the continuous strip cast sheet can be used as tube to combine with clad fin material in a heat exchanger; in this case, at least one of the flat surfaces of the said continuous cast sheet is coated with a reactive flux or a normal flux. Another example is that the continuous strip cast sheet can be used as header in a heat exchanger; in this case, at least one of the flat surfaces of the said continuous cast sheet is coated with Al—Si powders.

The invention claimed is:

1. A method of producing aluminium alloy sheet material comprising an AA3xxx alloy, which comprises:

continuous strip casting of a sheet at a solidification rate in a range from $10^2$ to $10^3$° C./sec to produce material microstructure exhibiting primary Fe-bearing particles of the type $Al_6(Fe,Mn)$ and α-AlMnFeSi having average size below 1 micrometer, and cold rolling of the strip cast sheet to an appropriate gauge with optional intermediate annealing during the cold rolling.

2. A method according to claim 1, wherein the sheets are further annealed during cold rolling.

3. A method according to claim 1, wherein the alloy is cast to 4.5 mm thick strip and cold rolled to 0.58 mm followed by an intermediate annealing.

4. A method according to claim 1, wherein the intermediate annealing is undertaken in an air furnace by heating from room temperature to 340° C. at 30° C./hour and soaking at 340° C. for 3 hours.

5. A method according to claim 4, wherein after the soaking, the material is cooled from 340° C. to 200° C. at 50° C./hour, and the material is cooled in air.

6. A method according to claim 2, wherein after annealing, the material was further cold rolled to 60 μm.

7. A method according to claim 2, wherein the alloy is cast to 4.5 mm thick strip and cold rolled to 0.58 mm followed by an intermediate annealing.

8. A method according to claim 2, wherein the intermediate annealing is undertaken in an air furnace by heating from room temperature to 340° C. at 30° C./hour and soaking at 340° C. for 3 hours.

9. A method according to claim 3, wherein the intermediate annealing is undertaken in an air furnace by heating from room temperature to 340° C. at 30° C./hour and soaking at 340° C. for 3 hours.

10. A method according to claim 8, wherein after the soaking, the material is cooled from 340° C. to 200° C. at 50° C./hour, and the material is cooled in air.

11. A method according to claim 9, wherein after the soaking, the material is cooled from 340° C. to 200° C. at 50° C./hour, and the material is cooled in air.

12. A method according to claim 3, wherein after annealing, the material was further cold rolled to 60 μm.

13. A method according to claim 4, wherein after annealing, the material was further cold rolled to 60 μm.

14. A method according to claim 5, wherein after annealing, the material was further cold rolled to 60 μm.

* * * * *